United States Patent [19]

Johnston

[11] Patent Number: 4,538,681

[45] Date of Patent: Sep. 3, 1985

[54] SOFT SET AND PULL LATCH AND SETTING TOOL FOR A WELL MEASURING INSTRUMENT

[75] Inventor: Russell A. Johnston, Houston, Tex.

[73] Assignee: Camco, Incorporated, Houston, Tex.

[21] Appl. No.: 681,049

[22] Filed: Dec. 13, 1984

[51] Int. Cl.[3] ..... E21B 23/03

[52] U.S. Cl. ..... 166/125; 166/117.6

[58] Field of Search ..... 166/123, 125, 181, 250, 166/117.5, 117.6; 267/125, 137; 267/166, 174, 380

[56] References Cited

U.S. PATENT DOCUMENTS

| | | | |
|---|---|---|---|
| 2,737,245 | 3/1956 | Knox | 166/125 |
| 3,163,225 | 12/1964 | Perkins | 166/123 |
| 3,957,260 | 5/1976 | Martin | 267/174 |
| 4,159,643 | 7/1979 | Watkins . | |

FOREIGN PATENT DOCUMENTS

| | | | |
|---|---|---|---|
| 260323 | 4/1970 | U.S.S.R. | 267/137 |

*Primary Examiner*—James A. Leppink
*Assistant Examiner*—John F. Letchford
*Attorney, Agent, or Firm*—Fulbright & Jaworski

[57] ABSTRACT

A soft set and pull latch for setting and pulling a measuring instrument in a well conduit. The latch includes a body with a seal, a fishing shoulder and a no-go shoulder. A measuring instrument support is attached to the body by a shock absorber. Locking dogs are radially and longitudinally movable in the body. A dog expander sleeve includes a recess for allowing the dogs to retract and includes a shoulder for locking the dogs outwardly. A locking spring urges the dogs downwardly onto the sleeve shoulder but allows the dogs to move upwardly into alignment with the sleeve recess. A releasing spring acts on the expander sleeve for urging the sleeve upwardly for moving the sleeve shoulder under the dogs but allows the dogs to retract into the sleeve recess on downward movement of the sleeve relative to the body. The body may include pressure equalizing ports and a pressure prong releasably positioned in the body and initially blocking the port.

5 Claims, 7 Drawing Figures

16

14
18
40
44
10
22
12

75
77
78
18
62
60
48
28
80
76
24
46
10
81

SOFT SET AND PULL LATCH AND SETTING TOOL FOR A WELL MEASURING INSTRUMENT

BACKGROUND OF THE INVENTION

It is well known to utilize a well measuring instrument, such as a pressure gauge, in a well conduit for measuring well pressure as disclosed in U.S. Pat. No. 4,159,643.

The present invention is directed to a latch and setting tool for setting and releasing a well measuring instrument from a well conduit without subjecting the measuring instrument to excessive jarring. That is, most well measuring instruments are sensitive, expensive, and cannot be subjected to the usual jarring that most subsurface well tools receive when they are set and released in and from a well conduit.

SUMMARY

The present invention is directed to a soft set and pull latch for setting and pulling a measuring instrument in a well conduit in which the conduit includes a stop shoulder and a locking notch. The latch includes a body having a fishing shoulder for setting and removing the body, and includes a no-go shoulder for positioning the body in the well conduit. A measuring instrument support is connected to the body. A plurality of locking dogs are radially and longitudinally movable in the body for coacting with the locking notch for setting and releasing the body in the well conduit. A dog expander sleeve is longitudinally movable in the body and the sleeve includes a recess for allowing the dogs to retract into the body and includes a shoulder for locking the dogs in an outward position. Locking spring means in the body yieldably urges the dogs downwardly onto the sleeve shoulder but allow the dogs to move upwardly into alignment with the sleeve recess when the dogs contact the well conduit stop shoulder and thereafter move the dogs outwardly into a locking position. Releasing spring means between the body and the expander sleeve yieldably urge the sleeve upwardly for moving the sleeve shoulder under the dogs but allow the dogs to retract into the sleeve recess upon downward movement of the sleeve relative to the body for aligning the dogs with the sleeve recess.

A still further object of the present invention is wherein the instrument support is telescopically connected to the body by a shock absorber for isolating the support from any shock applied to the body.

Still a further object is wherein the body includes a seal and pressure equalizing ports and a pressure prong is releasably positioned in the body initially blocking the ports.

Still a further object of the present invention is wherein the dog expander sleeve extends out of the top of the body for longitudinal actuation relative to the body for releasing the latch.

Still a further object of the present invention is wherein the prong includes seal means above and below the equalizing ports and includes a passageway extending from above to below the seal means for balancing the pressure on the prong.

A further object is the provision of a setting tool for setting the latch and removing the setting tool without shear means.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present invention will be described in connection with setting and pulling a bottom hole pressure gauge in a sidepocket mandrel, for purposes of illustration only, it is to be understood that various other types of well measuring instruments may be utilized and set in various portions of a well conduit.

Figure 1:
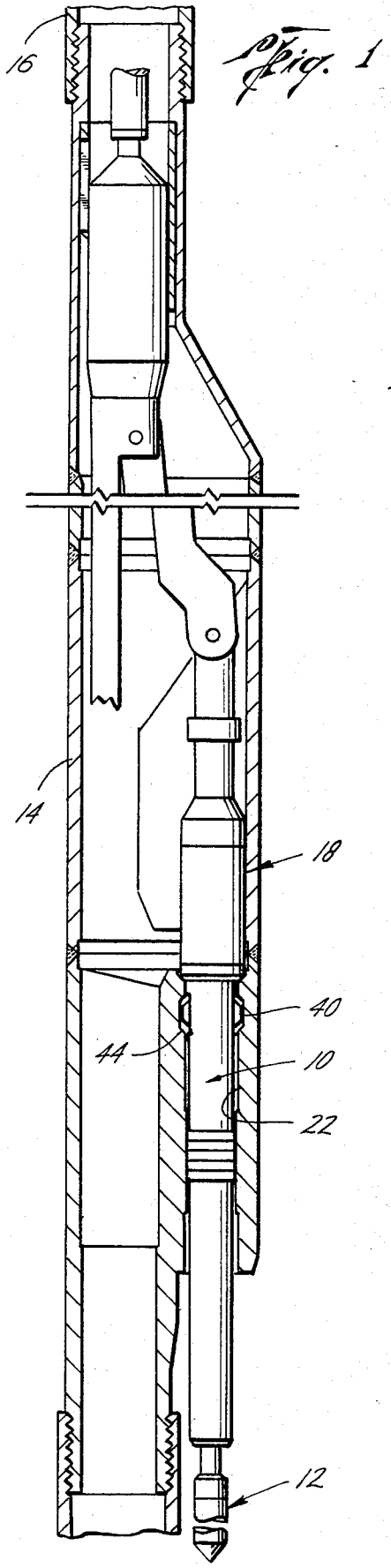
FIG. 1 is a fragmentary, elevational view, in cross section, illustrating a setting tool setting the latch of the present invention having a measuring instrument, into the sidepocket of a sidepocket mandrel in a well conduit.

Referring now to FIG. 1, the soft set and pull latch of the present invention is generally indicated by the reference numeral 10 and is shown carrying a bottom hole pressure gauge 12 and as being installed in the sidepocket 22 of a well mandrel 14 which in turn is connected in a well conduit or well tubing 16 by a setting tool 18 by means of a kickover tool 20. A suitable kickover tool and sidepocket mandrel are more fully described in U.S. Pat. No. 3,741,299 with the exception that the sidepocket in the mandrel 14 of FIG. 1 includes an opening extending out of the bottom of the sidepocket 22 so that the measuring instrument 12 can measure conditions in the annulus between a well casing (not shown) and the well tubing 16.

Figure 2A:
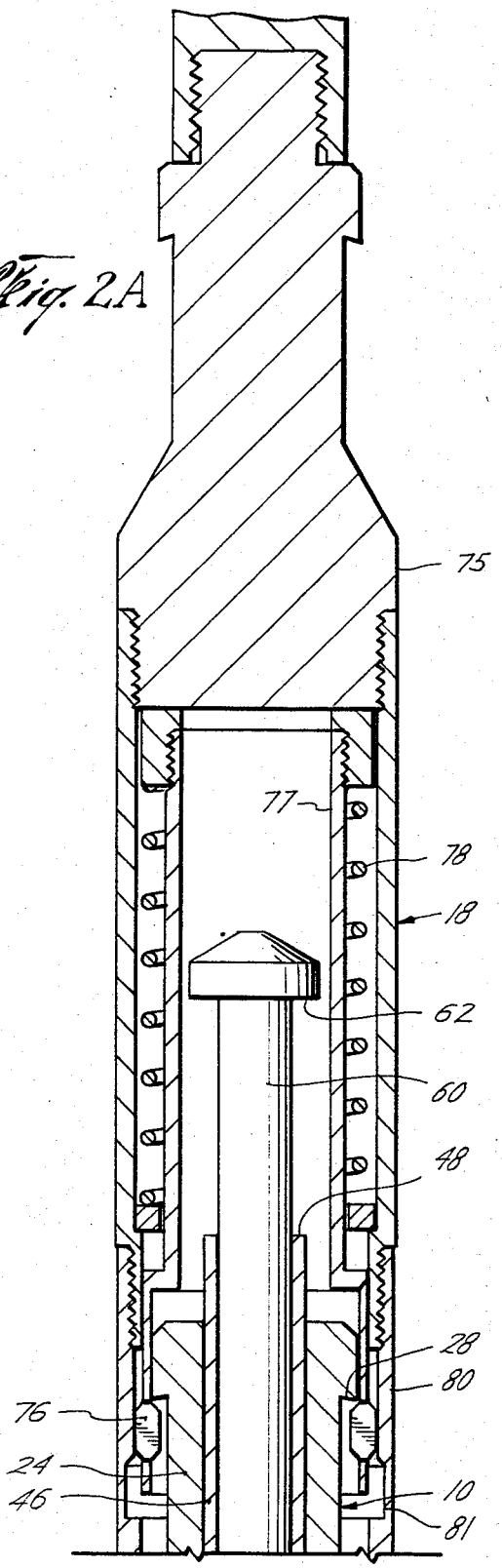
FIGS. 2A, 2B and 2C, are continuations of each other and are an enlarged elevational view, in cross section, illustrating the latch of the present invention being installed in a pocket of a sidepocket mandrel.
Figure 2B:
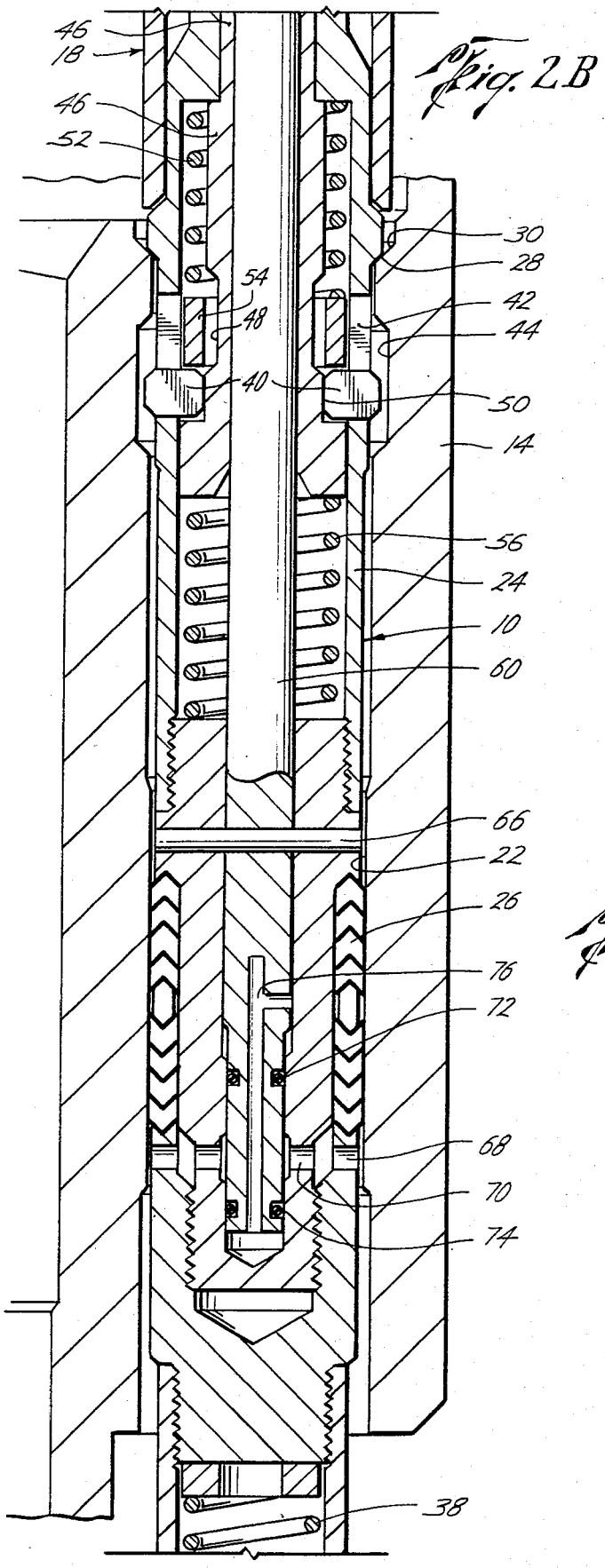
Figure 2C:
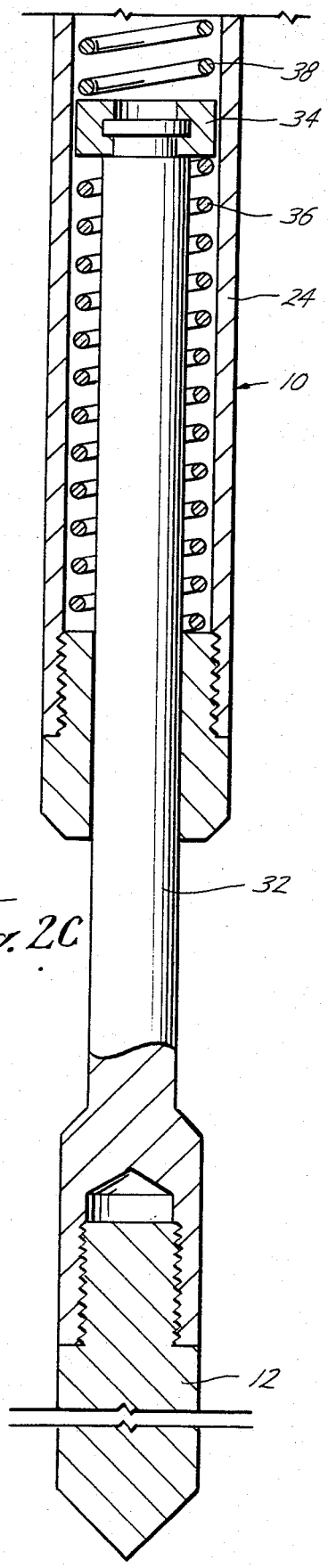

Referring now to FIGS. 2A, 2B and 2C, the latch 10 of the present invention generally includes a housing 24 which includes a seal 26 about its exterior for sealing against the interior of the pocket 22, a fishing shoulder 28 for setting and removing the body 24, and a no go shoulder 28 for engaging a stop shoulder 30 in the side pocket 22 for properly positioning the body 24 in the side pocket 22.

A measuring instrument support 32 may be telescopically connected to the body 24 and suitable shock absorber means may be positioned between the body 24 and the support 32 for isolating the support 32 and thus the instrument 12 from any shock applied to the body 24. Thus, the support 32 may include a shoulder 34 and springs 36 and 38 resiliently supporting the shoulder 34 and thus the support 32 in the body 24.

A plurality of locking dogs 40 are positioned in the body 24 and are movable radially and longitudinally in the body through slots 42 allowing the dogs 40 to move outwardly to a locking position in a locking notch 44 in the side pocket 22. The dogs 40 may be retracted into the body 24 for setting and pulling the body 24.

A dog expander sleeve 46 is longitudinally movable in the body and preferably has a top 48 extending out of the top of the body 24 for longitudinal actuation relative to the body for releasing the body 24 from the side pocket 22 as will be more fully discussed hereinafter. The sleeve 46 includes a recess 48 for allowing the dogs 40 to retract into the body 24 for setting and pulling the latch 10 and includes a locking shoulder 50 for locking the dogs 40 in an outward locked position in the locking notch 44 (FIG. 2B).

Locking spring means 52 are positioned in the body yieldably acting against a ring 54 and the dogs 40 for yieldably urging the dogs 40 downwardly onto the locking sleeve shoulder 50. The spring 52 also allows the dogs 40 to move upwardly into alignment with the sleeve recess 48 when the dogs encounter the stop shoulder 30 for inserting the latch 10 into the side pocket 22. That is, on movement of the body 22 downwardly into the side pocket 22, the bottom of the locking dogs 40 will contact the stop shoulder 30 and further downward movement of the body 22 will compress the spring 52 allowing the dogs 40 to move upwardly in the slots 42 and become aligned with the recess 48 at which time the dogs 40 will move inwardly into the recess 48 allowing the dogs 40 to move past the stop shoulder 30. After the dogs 40 have moved past the stop shoulder 30 and into alignment with the locking notch 44, the spring 52 will again move the dogs 40 downwardly in the slots 42 and onto the locking shoulder 50 causing the dogs 40 to expand outwardly into the locking notch 44. Thus, when the no go 28 contacts the stop shoulder 30, the locking dogs 40 extend outwardly into the notch 44 and lock the latch 10 in position in the pocket 22.

Releasing spring means 56 are positioned in the body 24 and yieldably urged the expander sleeve 46 upwardly for moving and holding the sleeve 46 in position with the locking shoulder 50 in position for locking the dogs 40 in the notch 44. However, when the spring 56 is compressed, as best seen in FIG. 3C, on downward movement of the sleeve 46 relative to the body 24, the dogs 40 are aligned with the sleeve recess 48 for pulling the body 24 from the pocket 22.

Referring now to FIGS. 2A and 2B, a prong 60 having a fishing head 62 extends into the body 24 and is secured therein by a shear pin 66. The body 24 includes equalizing ports 68 and 70 which are in communication with the prong 60. The prong 60 includes first seal means 72 and second seal means 74 above and below the ports 68 and 70, respectively, for initially preventing pressure from below the latch end from bypassing the seal 26. Preferably the prong 60 includes a passageway 76 extending from above the seals 72 and 74 to below the seals 72 and 74 for pressure balancing the prong 60. The prong 60 is removed from the body 24 prior to release of the latch 10 for equalizing the pressure across the latch 10 prior to release.

For setting the latch 10, the setting tool 18 includes a housing 75 having a plurality of dogs 76 which are urged upwardly in the setting tool 18 by a spring 78 acting on the dog extension 77 for engaging and supporting the latch 10 by the fishing shoulder 28. The dogs 76 are held in a locked position by the skirt 80 which includes a releasing recess 81. The setting tool 18 is attached to the fishing shoulder 28 by unscrewing the skirt 80 from the body 75 and moving extension 77 downwardly to align dogs 76 with the recess 81 and bypass the shoulder 28. Thereafter the body 75 and skirt 77 are reattached. Thus, the setting tool 18 carries the latch 10 downwardly in the well conduit 16 and is set into the side pocket 22 by the kickover tool 20 as is conventional. When the dogs 40 engage the stop shoulder 30 in the side pocket 22, the dogs 40 are moved upwardly and inwardly overcoming the spring 52 and bypass the shoulder 30 as the latch 10 is moved downwardly. After the dogs 40 pass the stop shoulder 30, the spring 52 moves the dogs 40 downwardly onto the shoulder 50 expanding the dogs 40 outwardly and into a locking position in the locking notch 44 as the no go shoulder 28 engages the stop shoulder 30. The latch 10 is now in the set position. It is to be noted that the only jarring required to set the latch 10 is the amount that may be necessary to move the seal 26 into the side pocket 22.

The setting tool 18 is then removed by merely a longitudinal upward pull overcoming the spring 78 to move the skirt 80 out from behind the dogs 76 allowing them to move into the releasing recess 81 and disengage from the fishing shoulder 28.

In order to remove the latch 10, it is necessary to make two downhole trips. During the first trip, the prong 60 is removed by a conventional pulling tool grabbing the fishing head 62, jarring upwardly to shear the pin 66 thereby removing the prong 60 and equalizing pressure above and below the latch through the ports 68 and 70. The jarring which is required to shear the pin 66 is applied to the dogs 40 and does not adversely affect the measuring instrument 12.

Figure 3B:
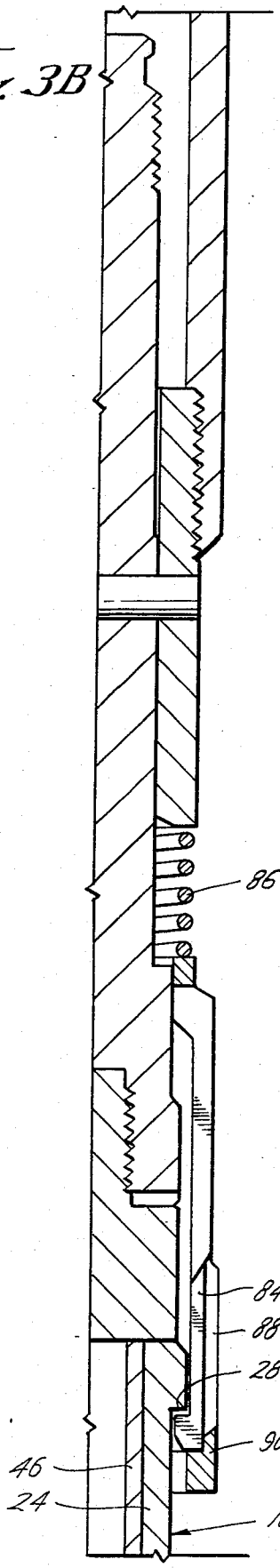
FIGS. 3A, 3B and 3C are continuations of each other and are quarter sections of a pulling tool releasing the latch of the present invention from its locked position.
Figure 3C:
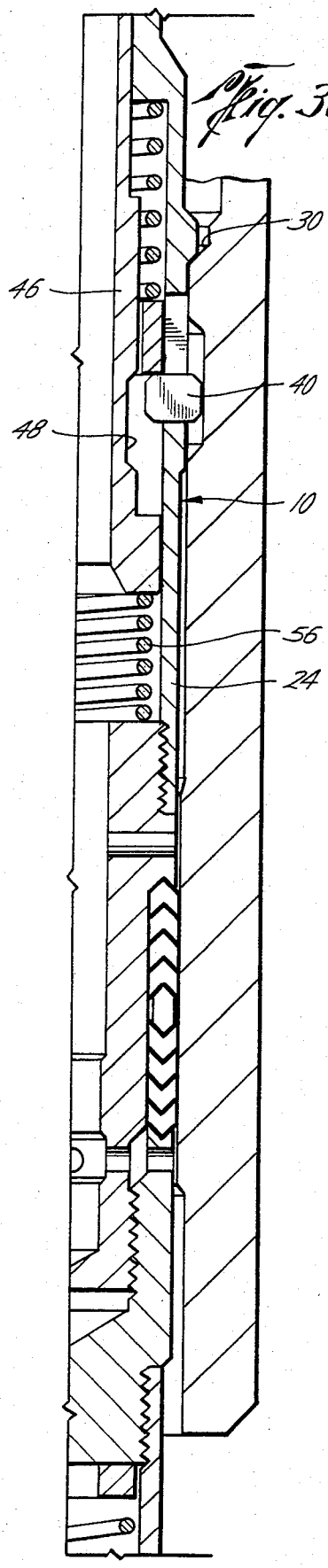
Figure 3A:
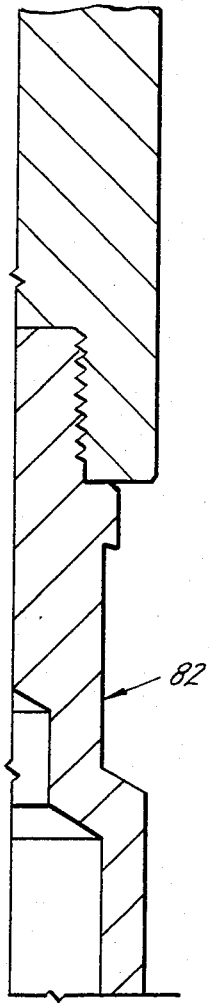

In order to thereafter retrieve the latch 10, a Camco Type JDC pulling tool generally indicated by the reference numeral 82, as best seen in Figs. 3A, 3B and 3C, is utilized to move downwardly into the well conduit 16 whereby the fingers 84 move upwardly and outwardly overcoming the spring 86 whereby the collet fingers 84 may move into a slot 88 and move over the fishing shoulder 28 to engage the shoulder 28 at which time the spring 86 moves the fingers 84 downwardly against the backup shoulder 90 so that the pulling tool 82 engages the body 24 for an upward pull. As the pulling tool 82 engages the fishing shoulder 28, it also pushes down the dog expander sleeve 46 overcoming the release spring 56 to bring the recess 48 into alignment with the dogs 40. Thereafter, an upward movement of the pulling tool 82 raises the body 24 and as the dogs 40 encounter the stop shoulder 30, they move inwardly into the recess 48 to bypass the stop shoulder 30 thereby retrieving the latch 10 and measuring instrument 12. Therefore, the latch 10 is pulled with only a minimum amount of jarring necessary to remove the seal 26 from the side pocket 22.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. A setting tool for setting a well tool having a fishing shoulder and a no go shoulder in a well conduit without requiring shear pins comprising, a housing, a skirt connected to the housing and adapted to extend over the fishing shoulder and engage the no go shoulder, said skirt including an internal releasing recess, a plurality of transversely and longitudinally movable dogs positioned in the skirt, spring means in the skirt urging the dogs upwardly and away from the releasing recess for allowing the dogs to engage the fishing shoulder of the well tool and support the well tool for setting the well tool in the well conduit but whereby upward movement of the housing relative to the well tool moves the releasing recess into alignment with the dogs and allows the setting tool to disengage from the well tool.

2. A soft set and pull latch device for setting and pulling a measuring instrument in a well conduit having a stop shoulder and a locking notch comprising, a body having a fishing shoulder and a no go shoulder, a measuring instrument support connected to the body, a plurality of locking dogs radially and longitudinally movable in the body, a dog expander sleeve longitudinally movable in the body, said sleeve including a recess for allowing the dogs to retract into the body and having a shoulder for locking the dogs in an outward position, locking spring means in the body yieldably urging said dogs onto the sleeve shoulder, but allowing the dogs to move into alignment with the sleeve recess, releasing spring means between the body and the expander sleeve for yieldably urging the sleeve in a direction to move the sleeve shoulder under the dogs, but allowing the dogs to retract into the sleeve recess upon movement of the sleeve relative to the body for aligning the dogs with the sleeve recess, said device including a setting tool comprising, a housing having a skirt, with an interior recess, the bottom of the skirt adapted to engage the top of the no go shoulder, a plurality of dogs positioned in the skirt for engaging the fishing shoulder of the latch, spring means in the skirt urging the dogs upwardly and away from the releasing recess whereby upward movement of the setting tool relative to the latch body allows the setting tool dogs to enter the releasing recess and disengage from the fishing shoulder.

3. A soft set and pull latch for setting and pulling a measuring instrument in a well conduit having a stop shoulder and a locking notch comprising, a body having a seal on the exterior for sealing in the conduit and having a fishing shoulder for setting and removing said body, and having a no go shoulder for positioning the body in the well conduit, said body including a plurality of longitudinally and radially extending slots, a measuring instrument support telescopically connected to the body, shock absorber means positioned between the body and said support for isolating the support from any shock applied to the body, a plurality of locking dogs positioned in said slots and radially and longitudinally movable in the slots, a dog expander sleeve longitudinally movable in the body and extending out of the top of the body for longitudinal actuation relative to the body, said sleeve including a recess for allowing the dogs to retract into the body and having a shoulder for locking the dogs in an outward position, a locking spring in the body yieldably urging said dogs downwardly onto the sleeve shoulder, but allowing the dogs to move upwardly and downwardly in said slots and into alignment with the sleeve recess when the dogs contact the stop shoulder, a releasing spring between the body and the expander sleeve for yieldably urging the sleeve upwardly for moving the sleeve shoulder under the dogs, but allowing the dogs to retract into the sleeve recess upon downward movement of the sleeve relative to the body for aligning the dogs with the sleeve recess.

4. The apparatus of claim 3 including, said body including pressure equalizing ports exposed to pressure below said seal, and a pressure prong releasably removable from the body and initially blocking said ports.

5. The apparatus of claim 4 wherein said prong includes seal means above and below said ports, and includes a passageway extending from above to below said seal means for balancing the pressure above the prong on said prong.

* * * * *